US009255681B2

(12) United States Patent
Ungru

(10) Patent No.: US 9,255,681 B2
(45) Date of Patent: Feb. 9, 2016

(54) LIGHTING DEVICE AND METHOD FOR OPERATING A LIGHTING DEVICE

(71) Applicant: OSRAM GmbH, Munich (DE)

(72) Inventor: Thomas Ungru, Ulm (DE)

(73) Assignee: OSRAM GmbH, Munich (DE)

( * ) Notice: Subject to any disclaimer, the term of this patent is extended or adjusted under 35 U.S.C. 154(b) by 126 days.

(21) Appl. No.: 14/108,450

(22) Filed: Dec. 17, 2013

(65) Prior Publication Data

US 2014/0218953 A1 Aug. 7, 2014

(30) Foreign Application Priority Data

Feb. 4, 2013 (DE) ..... 10 2013 201 766

(51) Int. Cl.
*F21S 8/10* (2006.01)

(52) U.S. Cl.
CPC ..... *F21S 48/115* (2013.01)

(58) Field of Classification Search
CPC ..... F21S 18/115
USPC ..... 362/545, 507, 249.05
See application file for complete search history.

(56) References Cited

U.S. PATENT DOCUMENTS 8,231,254 B2 7/2012 Beck et al.
2006/0232219 A1* 10/2006 Xu ..... 315/209 R

FOREIGN PATENT DOCUMENTS

WO 2010000610 A1 1/2010

* cited by examiner

*Primary Examiner* — David V Bruce
(74) *Attorney, Agent, or Firm* — Viering, Jentschura & Partner

(57) ABSTRACT

In various embodiments, a lighting device may include a plurality of semiconductor light sources, and an apparatus configured to operate the semiconductor light sources. The apparatus has switching means, by which the semiconductor light sources can be divided in groups for operation with the apparatus.

14 Claims, 5 Drawing Sheets

LIGHTING DEVICE AND METHOD FOR OPERATING A LIGHTING DEVICE

CROSS-REFERENCE TO RELATED APPLICATION

This application claims priority to German Patent Application Serial No. 10 2013 201 766.9, which was filed Feb. 4, 2013, and is incorporated herein by reference in its entirety.

TECHNICAL FIELD

Various embodiments relate generally to a lighting device and to a method for operating such a lighting device.

BACKGROUND

A lighting device of this type is disclosed in WO 2010/000610 A1, for example. Said document describes a lighting device for a motor vehicle headlight, said lighting device being equipped with a plurality of light emitting diodes and an operating apparatus for the light emitting diodes. The light emitting diodes are connected to the operating apparatus in a non-variable manner and operated simultaneously by means of the operating apparatus.

SUMMARY

In various embodiments, a lighting device may include a plurality of semiconductor light sources, and an apparatus configured to operate the semiconductor light sources. The apparatus has switching means, by which the semiconductor light sources can be divided in groups for operation with the apparatus.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

Figure 1:
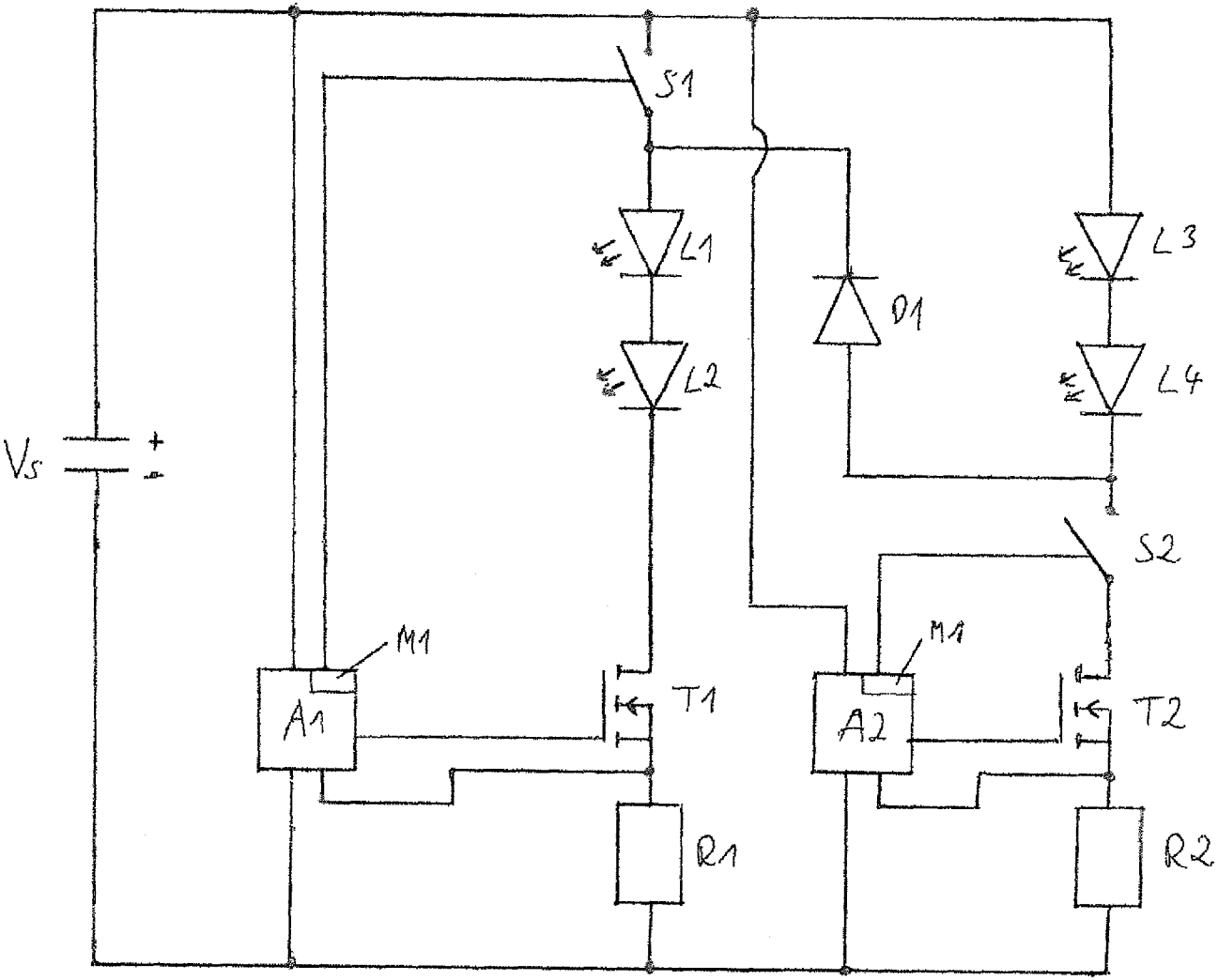
FIG. 1 shows a block diagram of the apparatus for operating the semiconductor light sources of the lighting device in accordance with a first embodiment.

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

The word "over" used with regards to a deposited material formed "over" a side or surface, may be used herein to mean that the deposited material may be formed "directly on", e.g. in direct contact with, the implied side or surface. The word "over" used with regards to a deposited material formed "over" a side or surface, may be used herein to mean that the deposited material may be formed "indirectly on" the implied side or surface with one or more additional layers being arranged between the implied side or surface and the deposited material.

Various embodiments provide a lighting device of the generic type whose electrical power consumption can be adapted to the available supply voltage, such that the semiconductor light sources of the lighting device can be operated both in the case of a low value for the supply voltage and in the case of a high value for the supply voltage.

The lighting device according to various embodiments has a plurality of semiconductor light sources and an apparatus for operating the semiconductor light sources, wherein the apparatus has switching means according to the invention, by which the semiconductor light sources can be divided in groups for operation with the apparatus. As a result, the interconnection of the semiconductor light sources with the apparatus either can be adapted to the value of the available supply voltage for the apparatus for operating the semiconductor light sources, in order to ensure that the semiconductor light sources operated with the apparatus can be operated both in the case of a low value of the supply voltage and in the case of a high value of the supply voltage, that is to say can be supplied with an electric current of sufficient current intensity, and the power loss is minimized, or the number of semiconductor light sources operated simultaneously with the apparatus can be varied depending on the desired lighting function or else depending on the value of the available supply voltage.

In accordance with various embodiments, the abovementioned switching means are designed in such a way that the lighting device is switchable between two operating states, such that in the case where a threshold value of the supply voltage for the apparatus for operating the semiconductor light sources is undershot, a first group of semiconductor light sources is connected in a parallel branch with respect to at least one further group of semiconductor light sources in accordance with a first operating state of the lighting device, and that in the case where said threshold value or a second, higher threshold value of the supply voltage for the apparatus for operating the semiconductor light sources is attained or exceeded, the first and the at least one further group of semiconductor light sources are connected in series in accordance with a second operating state of the lighting device. This ensures that all semiconductor light sources of the lighting device according to various embodiments, in the case of an excessively low supply voltage which does not permit operation of all the semiconductor light sources of the lighting device in series connection, can nevertheless be operated by means of the apparatus. As a result of the semiconductor light sources being divided into groups arranged in parallel branches, the available supply voltage is present at each group of semiconductor light sources, such that the supply voltage is divided only among the semiconductor light sources of the respective group, rather than among all the semiconductor light sources of the lighting device. An operating current of sufficient magnitude is thus ensured for all the semiconductor light sources.

In various embodiments, for this purpose, all the semiconductor light sources of the lighting device according to various embodiments can be divided into at least two groups of semiconductor light sources with the aid of the abovementioned switching means, which groups are either arranged in parallel branches or connected in series depending on the value of the supply voltage.

In various embodiments, the apparatus for operating the semiconductor light sources of the lighting device according to various embodiments has a control unit for the switching means and a detector for measuring the value of the supply voltage. As a result, it is possible to determine the present value of the supply voltage by means of the detector and to actuate the switching means with the aid of the control unit depending on the present value of the supply voltage determined by the detector. In various embodiments, the switching between groups of semiconductor light sources connected in parallel or in series is effected automatically by means of the switching means controlled by the control unit, depending on the present value of the available supply voltage determined by means of the detector.

The apparatus for operating the semiconductor light sources of the lighting device according to various embodiments may have at least one voltage converter designed as a series regulator and serving for regulating the electric current for the semiconductor light sources. The use of at least one series regulator for regulating the electric current for the semiconductor light sources has the advantage over other DC voltage converters, such as, for example, step-down converters, step-up converters, Cuk converters or Sepic converters, that a series regulator has a comparatively simple construction and is accordingly cost-effective. Moreover, a series regulator affords the further advantages that the voltage source has to supply only as much current as is needed at the output, and that makes possible a lighting device having good electromagnetic compatibility (EMC) because it produces no high-frequency voltages and has low noise. As a result, the lighting device according to various embodiments can be used for example as a light source in a motor vehicle headlight.

In various embodiments, the at least one series regulator of the lighting device according to various embodiments is designed as a low-drop series regulator. As a result, the at least one series regulator can be embodied using bipolar circuit technology and the power loss can be reduced.

In various embodiments, the at least one series regulator of the lighting device according to the invention includes a resistor having a temperature-dependent resistance value, for example a PTC thermistor (PTC) or an NTC thermistor (NTC). With the aid of a temperature-dependent resistance it is possible to vary the reference voltage for controlling the at least one series regulator depending on the operating temperature of the semiconductor light sources or the lighting device. As a result, so-called derating of the semiconductor light sources is made possible. That is to say that this makes it possible to reduce the electric current for the semiconductor light sources in the case of high thermal loading, in order to avoid damage to the semiconductor light sources.

As an alternative to the embodiments described above, in the lighting device according to various embodiments, the switching means can be designed in such a way that the semiconductor light sources can be divided into groups by actuation of the switching means, which groups are operated alternatively by means of the apparatus for operating semiconductor light sources. As a result, it is possible, for example in the case of an excessively low supply voltage that does not suffice for operating all the semiconductor light sources, or in the case of a lighting function that does not require all the semiconductor light sources of the lighting device, with the aid of the switching means, to connect and operate only a portion of the semiconductor light sources of the lighting device according to various embodiments with the apparatus. In various embodiments, the lighting device according to various embodiments, with the aid of the switching means, can be switched automatically between different operating modes depending on the value of the available supply voltage for the apparatus for operating the semiconductor light sources or depending on the signal of a sensor. For this purpose, in this alternative embodiment, provision is made of a control unit for the switching means and a detector for measuring the present value of the supply voltage. Alternatively or additionally, in the abovementioned embodiment, a sensor, for example a brightness sensor, can also be provided, in order to initiate the switching between the different lighting functions with the aid of the switching means depending on the sensor signal. As application examples, mention shall be made here of switching from daytime running light to low beam or switching from high beam to low beam in a motor vehicle.

The method according to various embodiments for operating a lighting device having a plurality of semiconductor light sources and an apparatus for operating the semiconductor light sources is distinguished by the fact that, according to the method according to various embodiments, the semiconductor light sources are divided in groups with the aid of switching means of the abovementioned apparatus. As a result, the interconnection of the semiconductor light sources either can be adapted to the value of the available supply voltage for the apparatus for operating the semiconductor light sources, in order to ensure that the semiconductor light sources operated with the apparatus can be operated both in the case of a low value of the supply voltage and in the case of a high value of the supply voltage, that is to say can be supplied with an electric current of sufficient current intensity, or the number of semiconductor light sources operated simultaneously with the apparatus can be varied, in order, for example, to realize different lighting functions. The semiconductor light sources are in various embodiments light emitting diodes or laser diodes.

In accordance with various embodiments of the method, the lighting device is switched between two operating states depending on the value of the supply voltage for the apparatus for operating the semiconductor light sources, such that in the case where a threshold value of the supply voltage is undershot, a first group of semiconductor light sources is connected in a parallel branch with respect to at least one further group of semiconductor light sources, and in the case where said threshold value or a second, higher threshold value of the supply voltage is attained or exceeded, the first and the at least one further group of semiconductor light sources are connected in series. This ensures that the semiconductor light sources of the lighting device according to various embodiments, in the case of an excessively low supply voltage which does not permit operation of all the semiconductor light sources of the lighting device in series connection, can nevertheless be operated by means of the apparatus. As a result of the semiconductor light sources being divided into groups arranged in parallel branches, the available supply voltage is present at each group of semiconductor light sources, such that the supply voltage is divided only among the semiconductor light sources of the respective group, rather than among all the semiconductor light sources of the lighting device. An operating current of sufficient magnitude is thus ensured for all the semiconductor light sources.

In accordance with various embodiments of the method, the semiconductor light sources of the lighting device are divided into groups by actuation of the switching means, which groups are operated alternatively by means of the apparatus. As a result, it is possible, for example in the case of an excessively low supply voltage that does not suffice for operating all the semiconductor light sources, or in the case of a lighting function that does not require the operation of all the semiconductor light sources, with the aid of the switching means, to operate only a portion of the semiconductor light sources of the lighting device according to the invention by means of the apparatus.

Figure 5:
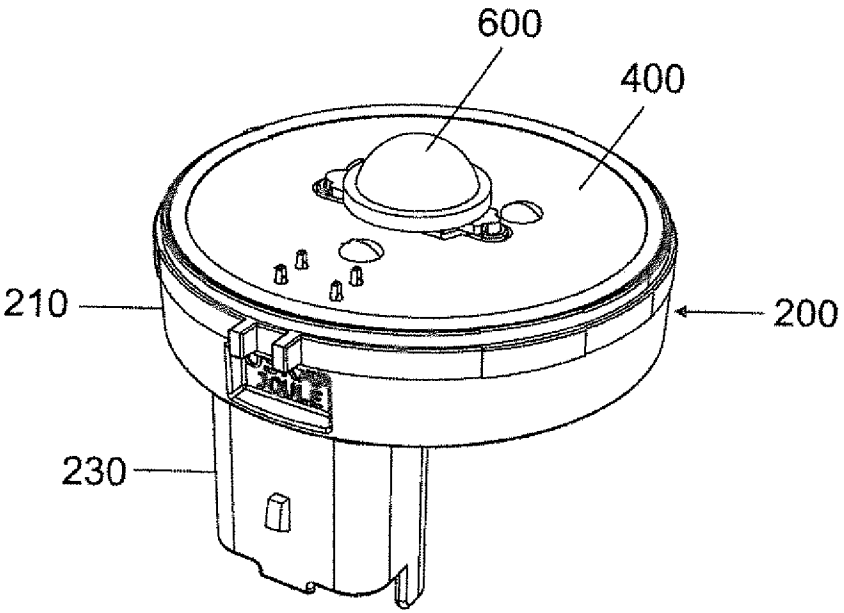
FIG. 5 shows a schematic illustration of the lighting device in accordance with the first embodiment.

FIG. 5 schematically illustrates a lighting device 200 in accordance with a first embodiment. Said lighting device 200 is provided for use as a light source in the fog lamp of a motor vehicle. The lighting device 200 has four light emitting diodes L1, L2, L3, L4, which emit white light during operation, a cylindrical housing 210 composed of plastic, a plug 230 arranged on the housing 210 and provided with the electrical connections of the lighting device, and a mounting circuit board 400 with, arranged thereon, components of an apparatus (not depicted) for operating the abovementioned light emitting diodes, and a transparent cover 600 for the light emitting diodes.

FIG. 1 shows a block diagram of the apparatus for operating the four light emitting diodes L1, L2, L3, L4 of the lighting device 200 in accordance with the first embodiment. The lighting device 200 or its apparatus for operating the light emitting diodes L1, L2, L3, L4 is fed with the supply voltage Vs. The supply voltage Vs is a DC voltage supplied by the on-board electrical power supply system of the motor vehicle. The value of the supply voltage Vs therefore corresponds to the present value of the on-board electrical power supply system voltage of the motor vehicle. The apparatus for operating the light emitting diodes L1, L2, L3, L4 in accordance with the first embodiment of the invention includes two switching means S1, S2, a diode D1 and two driver circuits T1, R1, A1 and T2, R2, A2, respectively, for the light emitting diodes L1, L2, L3, L4. The light emitting diodes L1, L2 form a first series-connected light emitting diode pair which is connected in series with the first switching means S1, the switching path of the transistor T1 and the resistor R1 of the first driver circuit T1, R1, A1. The supply voltage Vs is present at the series circuit including the abovementioned components. Analogously to that, the light emitting diodes L3, L4 form a second series-connected light emitting diode pair, which is connected in series to the second switching means S2, the switching path of the transistor T2 and the resistor R2 of the second driver circuit T2, R2, A2. The diode D1 in the forward direction connects the cathode of the light emitting diode L4 to the anode of the light emitting diode L1. The diode D1 can also be replaced by a third switching means, which is connected in opposite contact with respect to the two switching means S1, S2.

The switching state of the switching means S1 and S2 is dependent on the present value of the supply voltage Vs, said value corresponding to the value of the available on-board electrical power supply system voltage in the automobile. The value of the on-board electrical power supply system voltage in the automobile is nominally 12 V, but in fact usually lies in the range of 9 V to 19 V. Usually, that is to say in the case of a value of the supply voltage Vs of greater than 12 V, both switching means S1, S2 are in the open state, such that no current can flow through the switching means S1, S2. In this case, all four light emitting diodes L1, L2, L3, L4 are connected in series. In this case, the current flows from the positive pole of the supply voltage Vs via the light emitting diodes L3, L4, the forward-biased diode D1, the light emitting diodes L1, L2, the switching path of the transistor T1 and the resistor R1 to the negative pole or ground connection of the supply voltage Vs. The current for all four light emitting diodes L1, L2, L3, L4 is regulated by means of the first driver circuit T1, A1, R1 in this case.

The two switching means S1, S2 are switched by a control unit M1 simultaneously depending on the present value of the available supply voltage Vs. If the value of the presently available supply voltage Vs falls to values of less than or equal to 11 V, then both switching means S1, S2 are closed by means of the control unit M1, such that a current can flow through the switching means S1, S2. With closed switching means S1, S2 the first light emitting diode pair L1, L2 is arranged in a first current branch formed by the switching means S1, the light emitting diodes L1, L2 and the switching path of the transistor T1, while the second light emitting diode pair L3, L4 is arranged in a second current branch formed by the switching means S2, the light emitting diodes L3, L4 and the switching path of the transistor T2, said second current branch being connected in parallel with the first current branch. The diode D1 is turned off in this case and the current for the light emitting diodes L1, L2 of the first light emitting diode pair is regulated by means of the first driver circuit T1, A1, R1 in this case, while the current for the light emitting diodes L3, L4 of the second light emitting diode pair is regulated by means of the second driver circuit T2, A2, R2 in this case. The full supply voltage Vs is present in each case at the first and second current branches. If the value of the presently available supply voltage Vs increases again, such that it is at least 12 V, then both switching means S1, S2 change to the open switching state again by means of the control unit M1, such that all four light emitting diodes L1, L2, L3, L4 are operated in a manner connected in series again.

The above-described manner of operation ensures that the four light emitting diodes L1, L2, L3, L4 can be supplied with a current of sufficient current intensity, of 1 A, for example, even in the case of a value of the supply voltage Vs that is too low for the series circuit formed by all four light emitting diodes. In the case of an excessively low value of the supply voltage Vs, the four light emitting diodes L1, L2, L3, L4 are divided in pairs by the switching means S1, S2, such that the light emitting diodes L1, L2 of the first light emitting diode pair L1, L2, said light emitting diodes being connected in series with one another, are arranged in a parallel branch with respect to the second light emitting diode pair L3, L4 formed by the light emitting diodes L3, L4 connected in series with one another. The four light emitting diodes L1, L2, L3, L4 can in any case be supplied with the required current intensity of 1 A, for example.

Figure 2:
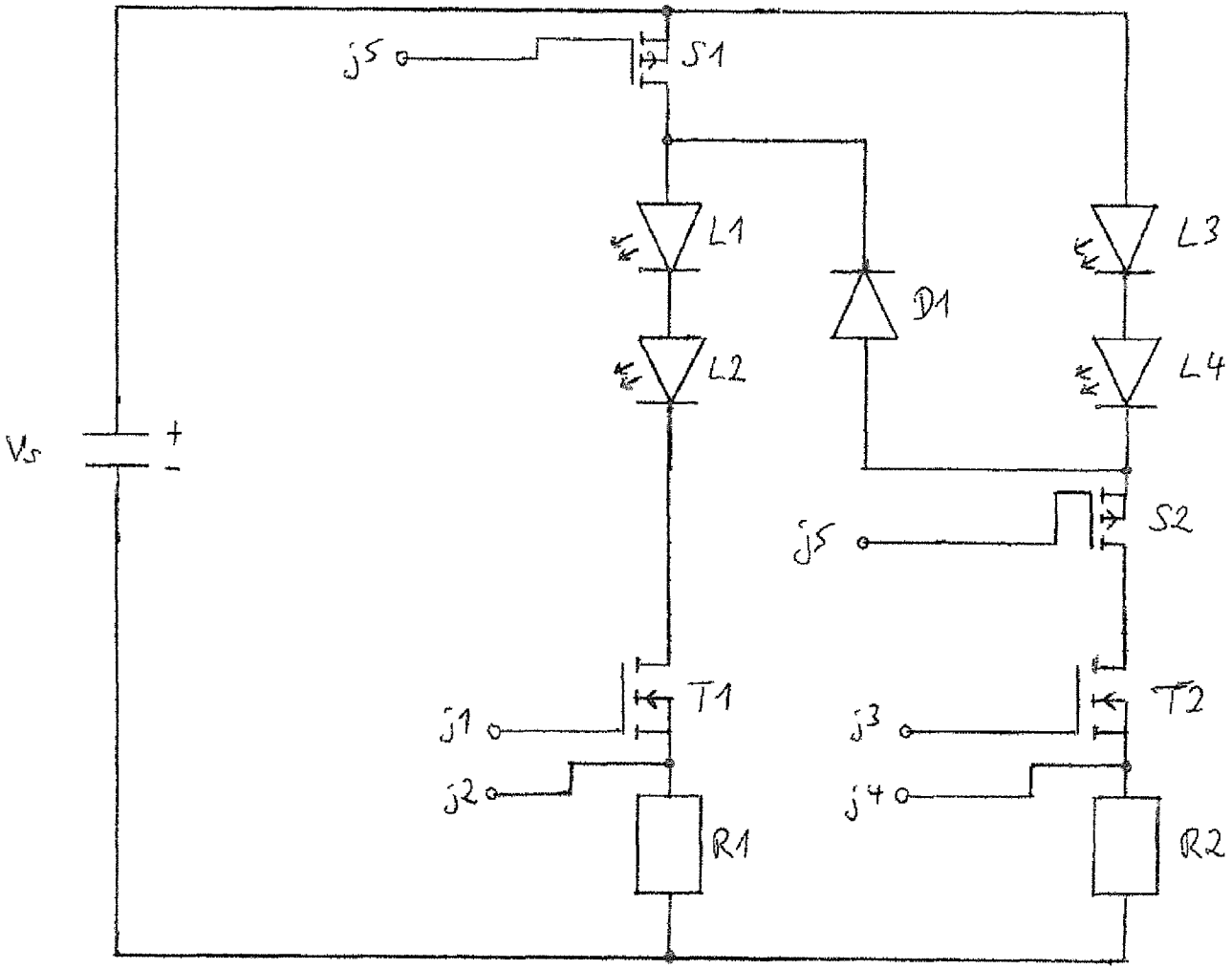
FIG. 2 shows circuit details of the apparatus—illustrated schematically in FIG. 1—for operating the semiconductor light sources of the lighting device in accordance with the first embodiment.
Figure 3:
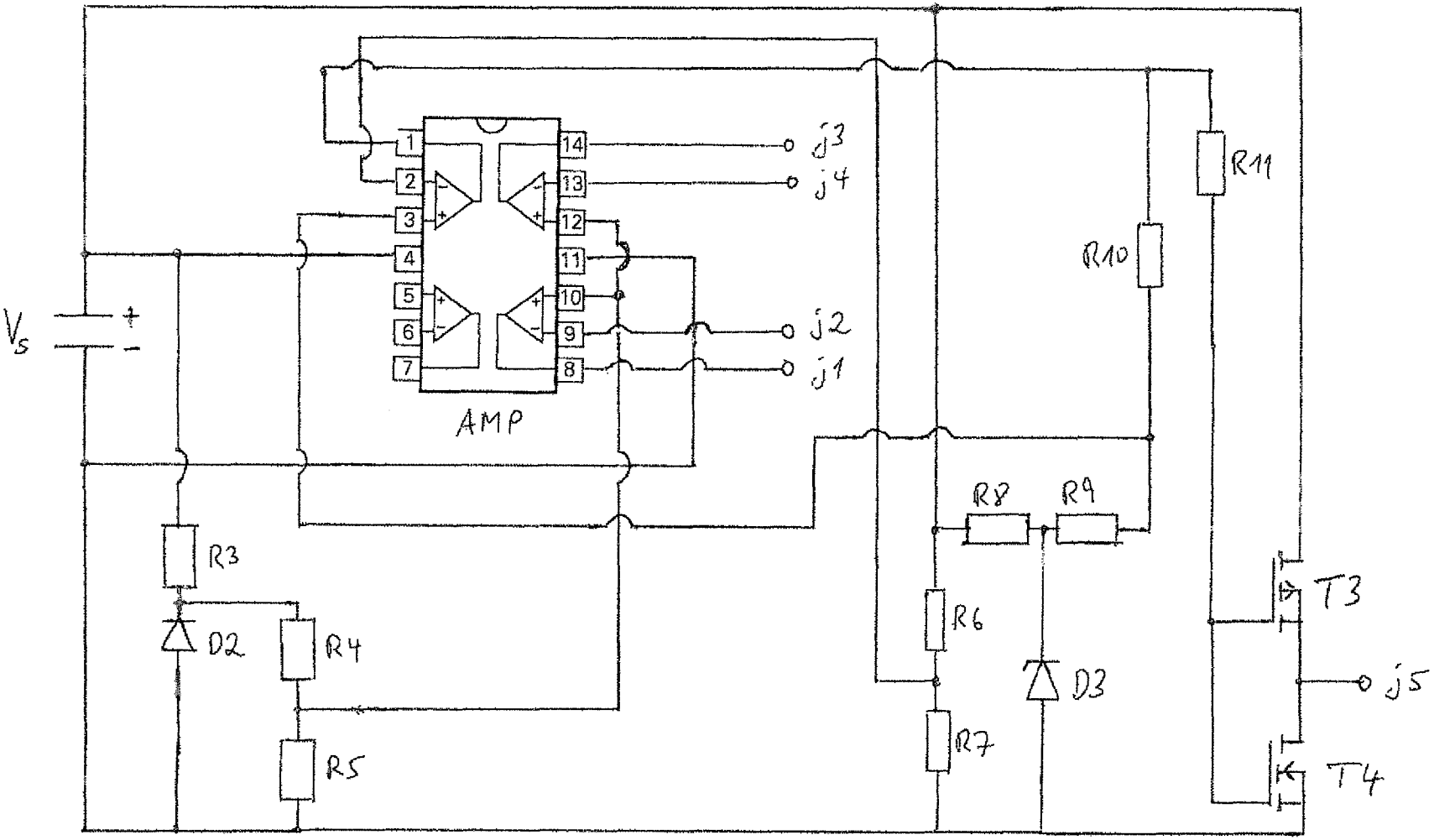
FIG. 3 shows further circuit details of the apparatus—illustrated schematically in FIG. 1—for operating the semiconductor light sources of the lighting device in accordance with the first embodiment.

FIG. 2 and FIG. 3 illustrate details of the driving apparatuses A1, A2 for the transistors T1, T2 of the two driver circuits and details of the switching means S1, S2 and the control unit M1 thereof. Identical components are provided with the same reference signs in FIG. 1 to FIG. 3. The components depicted in FIGS. 2 and 3 are connected to one another at the junction points j1 to j5. The two driver circuits for the light emitting diode pairs L1, L2 and L3, L4 are designed in each case as a linear voltage regulator, and in particular as a series regulator. The driving of the transistors T1, T2 and of the switching means S1, S2 is carried out with the aid of an operational amplifier component AMP, which includes four operational amplifiers and is designed as an SMD component. The abbreviation SMD stands for surface mounted device. The operational amplifier component AMP has fourteen terminals, wherein terminals 1 to 14 are allocated as follows:

terminal 1: output of the 1st operational amplifier terminal 2: inverting input of the 1st operational amplifier terminal 3: non-inverting input of the 1st operational amplifier terminal 4: supply voltage terminal (+)

terminal 5: non-inverting input of the 2nd operational amplifier terminal 6: inverting input of the 2nd operational amplifier terminal 7: output of the 2nd operational amplifier terminal 8: output of the 3rd operational amplifier terminal 9: inverting input of the 3rd operational amplifier terminal 10: non-inverting input of the 3rd operational amplifier terminal 11: supply voltage terminal (−)

terminal 12: non-inverting input of the 4th operational amplifier terminal 13: inverting input of the 4th operational amplifier terminal 14: output of the 4th operational amplifier The transistors T1, T2 of the driver circuits designed as series regulators for the light emitting diodes L1, L2, L3, L4 are in each case an n-channel field effect transistor and the switching means S1, S2 are designed in each case as a p-channel field effect transistor.

The gate electrode of the transistor T1 is connected via the junction point j1 to the terminal 8 of the operational amplifier component AMP and thus to the output of the third operational amplifier. The terminal 9 of the operational amplifier component AMP and thus the inverting input of the third operational amplifier is connected via the junction point j2 to a center tap between the source electrode of the transistor T1 and the resistor R1. The terminal 10 of the operational amplifier component AMP and thus the non-inverting input of the third operational amplifier is connected to a center tap between the resistors R4, R5 of a voltage divider D2, R2, R4, R5, which serves for generating a reference voltage for the two series regulators. Analogously thereto, the gate electrode of the transistor T2 is connected via the junction point j3 to the terminal 14 of the operational amplifier component AMP and thus to the output of the fourth operational amplifier. The terminal 13 of the operational amplifier component AMP and thus the inverting input of the fourth operational amplifier is connected via the junction point j4 to a center tap between the source electrode of the transistor T2 and the resistor R2. The terminal 12 of the operational amplifier component AMP and thus the non-inverting input of the fourth operational amplifier is connected to the center tap between the resistors R4, R5 of the voltage divider D2, R2, R4, R5.

The third operational amplifier of the operational amplifier component AMP, the transistor T1, the resistor R1 and the voltage divider D2, R3, R4, R5 form a first series regulator, which regulates the current through the light emitting diodes L1, L2, L3, L4 in the case of open switching means S1, S2 and regulates only the current through the light emitting diodes L1, L2 in the case of closed switching means. Analogously, the fourth operational amplifier of the operational amplifier component AMP, the transistor T2, the resistor R2 and the voltage divider D2, R3, R4, R5 form a second series regulator, which regulates the current through the light emitting diodes L3, L4 in the case of closed switching means S1, S2. The second operational amplifier of the operational amplifier component AMP is not required. Accordingly, the terminals 5, 6 and 7 of the operational amplifier component AMP are not allocated.

The voltage divider D2, R3, R4, R5 provides at its resistor R5 a reference voltage for the two series regulators. With the aid of the third operational amplifier of the operational amplifier component AMP, the transistor T1 is driven in such a way that the value of the reference voltage is established at the resistor R1. The current flowing through the resistor R1 is established according to Ohm's law. The same current also flows, in the case of open switching means S1, S2, through the light emitting diodes L1, L2, L3 and L4 connected in series with the resistor R1, or also flows, in the case of closed switching means S1, S2, through the light emitting diodes L1 and L2 connected in series with the resistor R1. The above-mentioned first series regulator thus regulates not only the voltage at the resistor R1, but also the current through the light emitting diodes L1, L2, L3 and L4 or L1 and L2. Analogously thereto, with the aid of the fourth operational amplifier of the operational amplifier component AMP, the transistor T2 is driven in such a way that the value of the reference voltage is established at the resistor R2. The current flowing through the resistor R2 is established according to Ohm's law. The same current also flows, in the case of closed switching means S1, S2 through the light emitting diodes L3 and L4 connected in series with the resistor R2. The abovmentioned second series regulator thus regulates not only the voltage at the resistor R2, but also the current through the light emitting diodes L3 and L4.

The resistor R4 of the voltage divider D2, R3, R4, R5 may be designed as a PTC thermistor in order to enable so-called derating of the light emitting diodes L1, L2, L3, L4, such that they are not thermally overloaded. The resistor R4 is thermally coupled to the light emitting diodes L1, L2, L3, L4. In the case of great heating of the light emitting diodes L1, L2, L3, L4 and of the PTC thermistor R4, its resistance value increases. As a result, the reference voltage at the resistor R5 is reduced according to the changed resistance ratio at the voltage divider D2, R3, R4, R5. Accordingly, the voltage at the resistor R1 or R2 is also regulated to a lower value and a reduced current flow through the light emitting diodes L1, L2, L3, L4 is generated as a result. Instead of designing the resistor R4 as a PTC thermistor, alternatively the resistor R5 can be designed as an NTC thermistor (NTC) for the same purpose.

The switching state of the switching means S1, S2 embodied as p-channel field effect transistors is controlled by means of the first operational amplifier of the operational amplifier component AMP. For this purpose, with the aid of voltage divider resistors R6, R7, the present value of the supply voltage Vs is measured at the resistor R7 and fed to the inverting input of the first operational amplifier at the terminal 2 of the operational amplifier component AMP. For the purpose mentioned above, by means of a second voltage divider consisting of a zener diode D3 and resistors R8, R9, the non-inverting input of the first operational amplifier at the terminal 3 of the operational amplifier component AMP is supplied with a reference voltage for the value of the supply voltage Vs measured at the resistor R7. The non-inverting input of the first operational amplifier is furthermore coupled with feedback by means of a resistor R10 to the output of the first operational amplifier at the terminal 1 of the operational amplifier component AMP. The output of the first operational amplifier is connected by a resistor R11 and a push-pull circuit consisting of the transistors T3, T4 via the junction point j5 to the gate electrodes of the two switching means S1, S2 designed as p-channel field effect transistors. The push-pull circuit T3, T4 inverts only the signal from the output of the first operational amplifier of the operational amplifier component AMP.

The zener diode D3 and the resistance values of the resistors R6, R7, R8, R9, R10 are coordinated with one another for the purpose of controlling the switching state of the switching means S1, S2 in such a way that the drain-source path of the two switching means S1, S2 is in the electrically insulating switching state in the case of a value of the supply voltage Vs of greater than or equal to 12 V, as a result of which all four light emitting diodes L1, L2, L3 and L4 are operated in a manner connected in series. If the value of the supply voltage Vs falls below 12 V, then the drain-source path of the two switching means S1, S2 firstly remains in the electrically insulating switching state. However if the value of the supply voltage Vs falls to a threshold value of less than or equal to 11 V, then the drain-source path of the two switching means S1, S2 is switched into the electrically conductive state, such that the light emitting diodes L1, L2 are arranged in a parallel branch with respect to the light emitting diodes L3, L4. If the value of the supply voltage Vs increases again to greater than or equal to 11 V, then the drain-source path of the two switching means S1, S2 firstly remains in the electrically conductive state. In the case where the value of the supply voltage increases further to a second threshold value of greater than or equal to 12 V, the drain-source path of the two switching means S1, S2 is switched into the electrically insulating state again. The switching of the drain-source path of the switching means S1, S2 between the two switching states is therefore effected with a hysteresis. This prevents the switching means S1, S2 from being constantly switched in the case of slight fluctuations of the value of the supply voltage Vs. The operation of the light emitting diodes L1, L2, L3, L4 of the lighting device according to various embodiments functions entirely satisfactorily in the value range of 6 V to 19 V for the supply voltage Vs.

Figure 4:
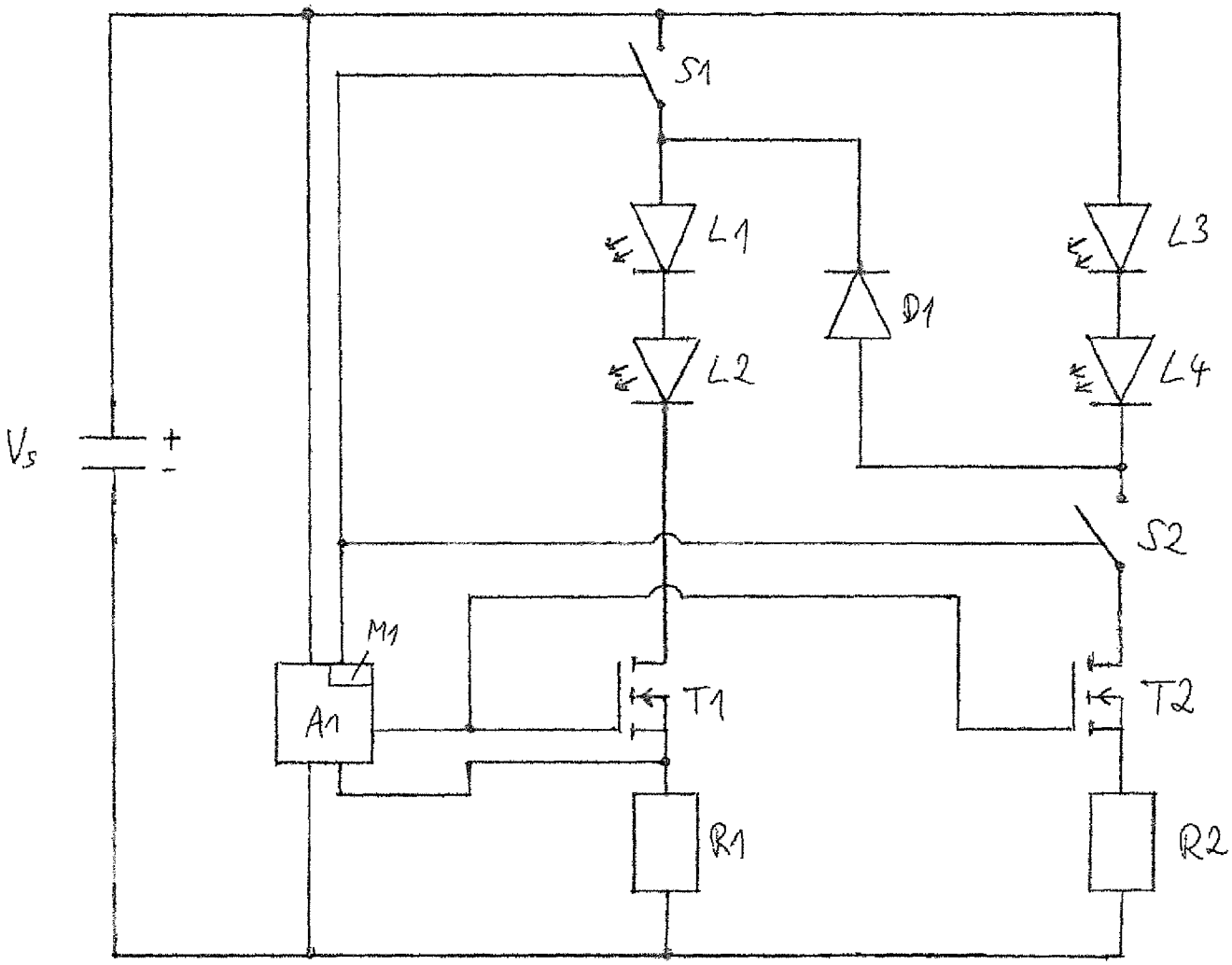
FIG. 4 shows a block diagram of the apparatus for operating the semiconductor light sources of the lighting device in accordance with the second embodiment.

FIG. 4 shows a block diagram of an apparatus for operating the semiconductor light sources of a lighting device in accordance with a second embodiment. The lighting device in accordance with the second embodiment differs from the lighting device in accordance with the first embodiment merely in that, in the lighting device in accordance with the second embodiment, the second series regulator for regulating the voltage at the resistor R2 and for regulating the current through the light emitting diodes L3, L4 is dispensed with. The transistor T2 receives at its gate electrode the same driving signal as the transistor T1. As a result, the terminals 12, 13, 14 of the operational amplifier component AMP that are assigned to the fourth operational amplifier are not required. In all other details, the lighting device in accordance with the second embodiment corresponds to the lighting device in accordance with the first embodiment.

The embodiments are not restricted to the embodiments described in greater detail above. By way of example, the lighting device according to various embodiments may also include more than just four light emitting diodes and the light emitting diodes can be divided into more than just two groups arranged in parallel branches. Moreover, the groups of light emitting diodes can have a different number of light emitting diodes. Furthermore, the lighting device according to various embodiments can also be adapted for operation at a different supply voltage, for example the truck on-board electrical power supply system voltage of nominally 24 V or at a helicopter on-board electrical power supply system voltage, or to battery-operated electric vehicles or to battery-operated luminaires.

In addition, various embodiments are also applicable to lighting devices which have a plurality of semiconductor light source modules instead of a plurality of semiconductor light sources. In the case of such lighting devices, the semiconductor light source modules can be divided in groups with the aid of the switching means, in order either to operate them alternatively by means of the apparatus or to operate them in a divided manner either in series connection or in parallel-connected current branches depending on the value of a supply voltage for the apparatus.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A lighting device, comprising:

a plurality of semiconductor light sources; and an apparatus configured to operate the semiconductor light sources;

wherein the apparatus has switching means, by which the semiconductor light sources can be divided in groups for operation with the apparatus, wherein the switching means are designed in such a way that the lighting device is switchable between two operating states depending on the value of a supply voltage, such that in the case where a threshold value of the supply voltage for the apparatus is undershot, a first group of semiconductor light sources is connected in a parallel branch with respect to at least one further group of semiconductor light sources in accordance with a first operating state, and that in the case where said threshold value or a second, higher threshold value of the supply voltage is attained or exceeded, the first and the at least one further group of semiconductor light sources are connected in series in accordance with a second operating state.

2. The lighting device of claim 1, wherein the apparatus has a control unit for the switching means and a detector configured to measure the value of the supply voltage.

3. The lighting device of claim 1, wherein the apparatus has at least one series regulator configured to regulate the electric current for the semiconductor light sources.

4. The lighting device of claim 3, wherein the at least one series regulator comprises a resistor having a temperature-dependent resistance value.

5. The lighting device of claim 1, wherein the switching means are designed in such a way that the semiconductor light sources can be divided into groups by actuation of the switching means, which groups can be operated alternatively by means of the apparatus.

6. The lighting device of claim 1, wherein the switching means are designed in such a way that their switching state is dependent on the value of a supply voltage for the apparatus for operating the semiconductor light sources.

7. A method for operating a lighting device, the method comprising:

providing a plurality of semiconductor light sources and an apparatus for operating the semiconductor light sources; and dividing the semiconductor light sources in groups with the aid of switching means of the apparatus, wherein the lighting device is switched between two operating states depending on the value of the supply voltage for the apparatus for operating the semiconductor light sources, such that in the case where a threshold value of the supply voltage is undershot, a first group of semiconductor light sources is arranged in a parallel branch with respect to at least one further group of semiconductor light sources, and in the case where said threshold value or a second, higher threshold value of the supply voltage is attained or exceeded, the first and the at least one further group of semiconductor light sources are connected in series.

8. The method of claim 7, wherein the semiconductor light sources are divided into groups by actuation of the switching means, which groups are operated alternatively by means of the apparatus.

9. A lighting device, comprising:

a plurality of semiconductor light sources; and an apparatus configured to control the semiconductor light sources;

wherein the apparatus comprises switches configured to divide the semiconductor light sources in groups for operation with the apparatus, wherein the switches are designed in such a way that the lighting device is switchable between two operating states depending on the value of a supply voltage, such that in the case where a threshold value of the supply voltage for the apparatus is undershot, a first group of semiconductor light sources is connected in a parallel branch with respect to at least one further group of semiconductor light sources in accordance with a first operating state, and that in the case where said threshold value or a second, higher threshold value of the supply voltage is attained or exceeded, the first and the at least one further group of semiconductor light sources are connected in series in accordance with a second operating state.

10. The lighting device of claim 9, wherein the apparatus has a controller for the switches and a detector configured to measure the value of the supply voltage.

11. The lighting device of claim 9, wherein the apparatus has at least one series regulator configured to regulate the electric current for the semiconductor light sources.

12. The lighting device of claim 11, wherein the at least one series regulator comprises a resistor having a temperature-dependent resistance value.

13. The lighting device of claim 9, wherein the switches are configured to divide the semiconductor light sources into groups by actuation of the switches, wherein the groups can be operated alternatively by means of the apparatus.

14. The lighting device of claim 9, wherein the switches are configured in such a way that their switching state is dependent on the value of a supply voltage for the apparatus for operating the semiconductor light sources.

* * * * *